US010121402B2

(12) United States Patent
Zhang

(10) Patent No.: US 10,121,402 B2
(45) Date of Patent: Nov. 6, 2018

(54) COMPENSATION METHOD OF MURA PHENOMENON OF CURVED LIQUID CRYSTAL PANEL

(71) Applicant: Shenzhen China Star Optoelectronics Technology Co., Ltd., Shenzhen (CN)

(72) Inventor: Hua Zhang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 287 days.

(21) Appl. No.: 15/039,415

(22) PCT Filed: Apr. 13, 2016

(86) PCT No.: PCT/CN2016/079161

§ 371 (c)(1),
(2) Date: May 26, 2016

(87) PCT Pub. No.: WO2017/152465

PCT Pub. Date: Sep. 14, 2017

(65) Prior Publication Data

US 2018/0122284 A1 May 3, 2018

(30) Foreign Application Priority Data

Mar. 9, 2016 (CN) ..... 2016 1 0133815

(51) Int. Cl.
*G09G 3/20* (2006.01)
*G09G 3/36* (2006.01)

(52) U.S. Cl.
CPC ..... *G09G 3/2007* (2013.01); *G09G 3/36* (2013.01); *G09G 3/3611* (2013.01); (Continued)

(58) Field of Classification Search
CPC ..... G09G 3/2007; G09G 3/3611; G09G 2320/0233; G09G 2320/0271; G09G 2320/0626; G09G 2360/145
See application file for complete search history.

(56) References Cited

U.S. PATENT DOCUMENTS

2013/0329057 A1* 12/2013 Al-Dahle ..... H04N 17/00 348/189
2016/0163246 A1* 6/2016 Lee ..... G09G 3/2003 345/690
2016/0210901 A1* 7/2016 Cha ..... G09G 5/10

FOREIGN PATENT DOCUMENTS

CN 102122870 A 10/2012
CN 105244007 A 1/2016

* cited by examiner

*Primary Examiner* — Afroza Chowdhury
(74) *Attorney, Agent, or Firm* — Leong C. Lei

(57) ABSTRACT

The present invention provides a compensation method of Mura phenomenon of a curved liquid crystal panel. First, obtaining image Mura compensation data of the curved liquid crystal panel according to a collected image of a camera, and the image Mura compensation data comprises: a Mura compensation value and a compensation point location corresponded with the Mura compensation value, and the compensation point location is a location of a compensation point in the collected image of the camera, and then implementing correction to the compensation point location in the obtained image Mura compensation data to acquire a compensation point location after correction, which is employed to replace the compensation point location in the image Mura compensation data to obtain plane Mura compensation data of the curved liquid crystal panel, and finally, implementing Mura compensation to the curved liquid crystal panel according to the plane Mura compensation data.

9 Claims, 3 Drawing Sheets

(52) U.S. Cl.
CPC ..... *G09G 2320/0233* (2013.01); *G09G 2320/0271* (2013.01); *G09G 2320/0626* (2013.01); *G09G 2360/145* (2013.01)

COMPENSATION METHOD OF MURA PHENOMENON OF CURVED LIQUID CRYSTAL PANEL

FIELD OF THE INVENTION

The present invention relates to a display technology field, and more particularly to a compensation method of Mura phenomenon of a curved liquid crystal panel.

BACKGROUND OF THE INVENTION

In the development direction of the Liquid Crystal Display (LCD) for being lighter, thinner, bigger, some uncontrollable factors in the practical processes result in that there are difference among the physical properties of respective positions of the LCD display panel. Thus, in an area larger than one pixel dot, the uneven brightness phenomenon as showing pure gray scale pictures is so called the Mura phenomenon in the industry.

The Mura phenomenon has already become the bottle neck restricting the development of LCD. By raising the art level or promoting purity of the row materials, the occurrence probability of the Mura phenomenon can be reduced. For the LCD display panel of which the manufacture process is accomplished, the physical properties are determined. For compensating the Mura phenomenon produced due to the defect in the LCD manufacture process, the gray scale compensation can be employed to calibrate the brightness of the pixel dot to improve the Mura phenomenon.

The gray scale compensation is to change the gray scale value of the pixel to achieve the improvement to the brightness uniformity: namely, the Mura condition of the gray scale image is shot by camera, and the normal region and the Mura region in the gray scale image are determined, and finally, the gray scale value of the Mura region is inversely compensated according to the gray scale value of the normal region, and as showing the pure gray scale pictures, a lower gray scale value is applied to the pixel of which the display brightness is higher, and a higher gray scale value is applied to the pixel of which the display brightness is lower. Then, the brightnesses of the respective pixels after the gray scale compensation are closely consistent to achieve the improvement to the Mura phenomenon.

At present, the curved liquid crystal TV has become more and more popular. However, after the panel is bent from the plane state to the curved state, the liquid crystal will appear unpredicted Mura cause of being squeezed by the glass bent stress (which newly appears after being bent and not exists as the panel is in the plane state). Therefore, the repair cannot be executed as the panel is in the plane state. Then, after the panel is bent to be curved, the only way of the Mura compensation repair is to be executed as the panel is in the curved state.

The Mura compensation repair methods in the industry are all based on that the panel is in the plane state. As shown in FIG. 1, the display areas of the panel shot by the camera in the plane state and in the curved state have difference. The plane length b in the curved state is smaller than the plane length a in the plane state. Thus, the present plane Mura compensation repair method cannot be directly used to calculate the Mura compensation values of the respective region locations as the panel is in the curved state, and a compensation method of Mura phenomenon applicable for a curved panel has to be developed.

SUMMARY OF THE INVENTION

An objective of the present invention is to provide a compensation method of Mura phenomenon of a curved liquid crystal panel, which can obtain the correct Mura compensation data as the curved liquid crystal panel is in the curved state to promote the product quality of the curved liquid crystal panel.

For realizing the aforesaid objective, the present invention provides a compensation method of Mura phenomenon of a curved liquid crystal panel, comprising steps of:

step 1, providing the curved liquid crystal panel and a camera, and shooting the curved liquid crystal panel of showing an image with the camera, and obtaining image Mura compensation data of the curved liquid crystal panel according to a collected image;

the image Mura compensation data comprises: a Mura compensation value and a compensation point location corresponded with the Mura compensation value, and the compensation point location is a location of a compensation point in the collected image of the camera;

step 2, implementing correction to the compensation point location in the image Mura compensation data obtained in the step 1 to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel;

step 3, implementing Mura compensation to the curved liquid crystal panel according to the plane Mura compensation data obtained in the step 2.

In the step 1, the camera is in a fixed position for shooting the LCD panel.

In the step 1, the image collected by the camera is a plane image.

The camera is in above a center point of the curved liquid panel for shooting.

In the step 2, a formula of implementing correction to the compensation point location in the image Mura compensation data obtained in the step 1 is:

$$z=\arctan(y/x)\pi/180 \quad (1),$$

wherein z is a distance from the position of the compensation point in the plane development diagram of the curved liquid crystal panel to a vertical center line in the plane development diagram, and y is a distance from the position of the compensation point in the image collected by the camera to a vertical center line of the image, and $x=R\times\cos\{\arcsin[b/(2R)]\}$, and R is a radius of curvature as the curved liquid crystal panel is in a curved state, and b is a length of the image collected by the camera.

In the step 1, the camera shoots the curved liquid crystal panel three times, and gray scales of images as shooting the curved liquid crystal panel for the three times are different, and there are three copies of the obtained image Mura compensation data.

In the step 1, a gray scale of an image shown by the curved liquid crystal panel is selected from a gray scale range including a 0 gray scale and a maximum gray scale.

The maximum gray scale is 255 gray scale.

The present invention further provides a compensation method of Mura phenomenon of a curved liquid crystal panel, comprising steps of:

step 1, providing the curved liquid crystal panel and a camera, and shooting the curved liquid crystal panel of showing an image with the camera, and obtaining image Mura compensation data of the curved liquid crystal panel according to a collected image;

the image Mura compensation data comprises: a Mura compensation value and a compensation point location corresponded with the Mura compensation value, and the compensation point location is a location of a compensation point in the collected image of the camera;

step 2, implementing correction to the compensation point location in the image Mura compensation data obtained in the step 1 to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel;

step 3, implementing Mura compensation to the curved liquid crystal panel according to the plane Mura compensation data obtained in the step 2;

wherein in the step 1, the camera is in a fixed position for shooting the LCD panel;

wherein in the step 1, the camera shoots the curved liquid crystal panel three times, and gray scales of images as shooting the curved liquid crystal panel for the three times are different, and there are three copies of the obtained image Mura compensation data.

The benefits of the present invention: the present invention provides a compensation method of Mura phenomenon of a curved liquid crystal panel. First, obtaining image Mura compensation data of the curved liquid crystal panel according to a collected image of a camera, and the image Mura compensation data comprises: a Mura compensation value and a compensation point location corresponded with the Mura compensation value, and the compensation point location is a location of a compensation point in the collected image of the camera, and then implementing correction to the compensation point location in the obtained image Mura compensation data to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel, and finally, implementing Mura compensation to the curved liquid crystal panel according to the plane Mura compensation data. Accordingly, the position of the compensation point in the curved liquid crystal panel can be accurately found to correctly implement Mura compensation to the curved liquid crystal panel in the curved state and to promote the product quality of the curved liquid crystal panel.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
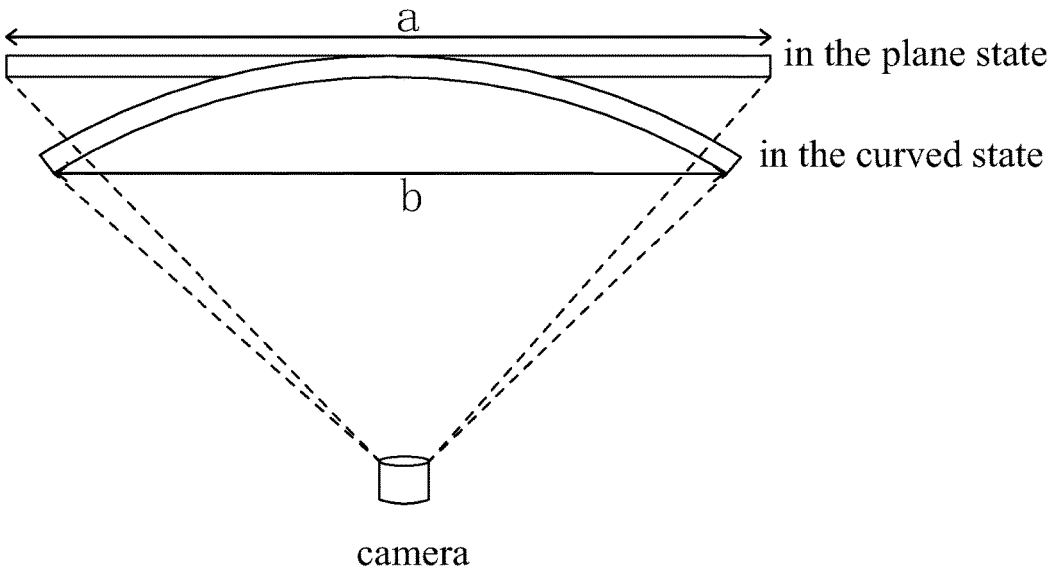
Fig. 1 (Prior Art)
FIG. 1 is a contrast diagram of one liquid crystal panel in the plane state and in the curved state which is shot by camera.
Figure 2:
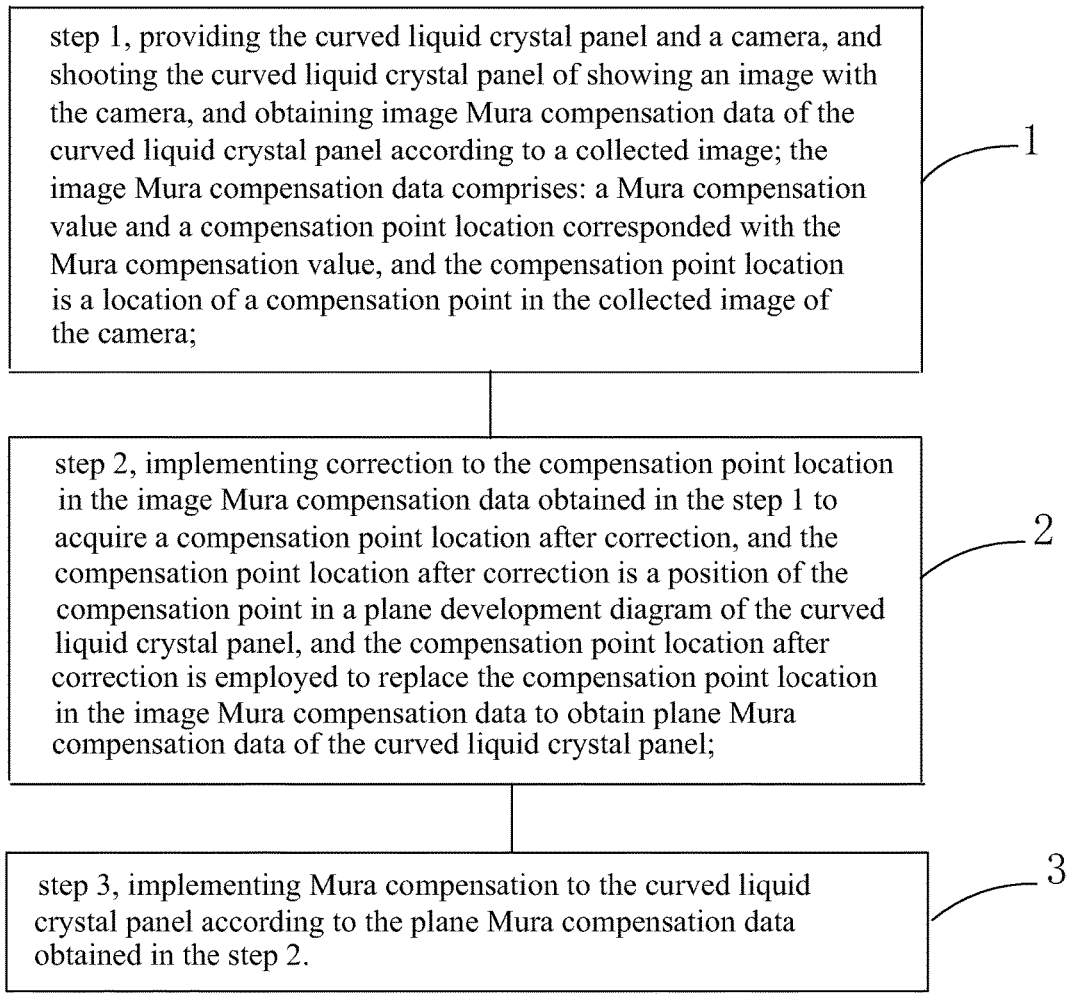
FIG. 2 is a flowchart of a compensation method of Mura phenomenon of a curved liquid crystal panel according to the present invention.
Figure 3:
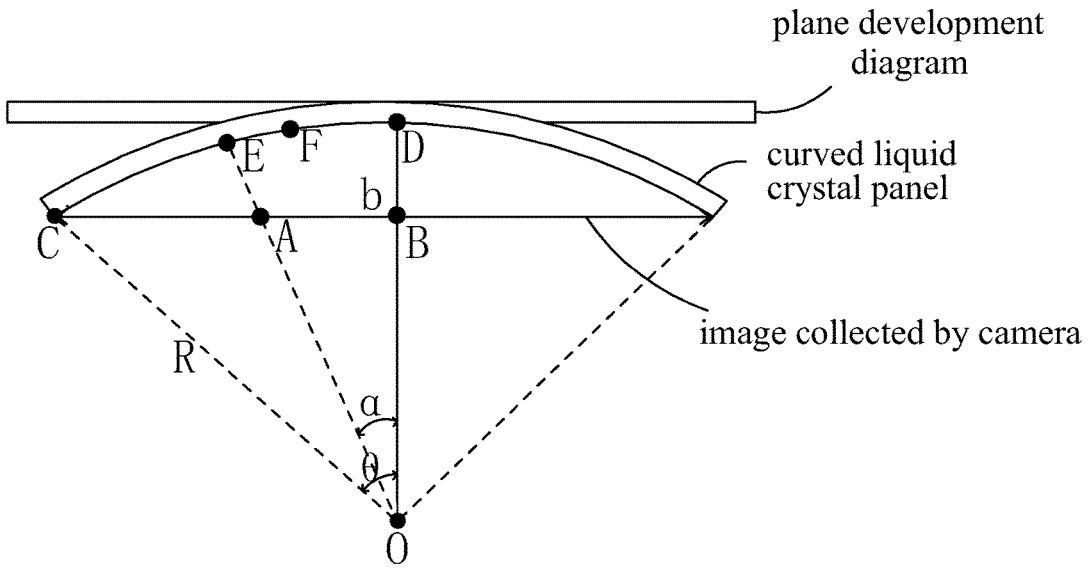
FIG. 3 is a diagram of the step 2 of a compensation method of Mura phenomenon of a curved liquid crystal panel according to the present invention.

Please refer to FIG. 2. The present invention provides a compensation method of Mura phenomenon of a curved liquid crystal panel, comprising steps of:

step 1, providing the curved liquid crystal panel and a camera, and shooting the curved liquid crystal panel of showing an image with the camera, and obtaining image Mura compensation data of the curved liquid crystal panel according to a collected image, and the image Mura compensation data comprises: a Mura compensation value and a compensation point location corresponded with the Mura compensation value, and the compensation point location is a location of a compensation point in the collected image of the camera;

Specifically, in the step 1, the camera is in a fixed position for shooting the LCD panel. Preferably, the camera is in above a center point of the curved liquid panel for shooting.

step 2, implementing correction to the compensation point location in the image Mura compensation data obtained in the step 1 to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel;

Specifically, referring to FIG. 3, because the image shot by the camera must be a plane image and as regarding the curved liquid crystal panel in the curved state, once the Mura compensation calculation method in the plane state is still utilized, the Mura compensation system will put the compensation data of the E point location (which the camera confirms to be A point) on the curved liquid crystal panel on the F point location (the curve length DF is equal to the length of the straight line AB), and cause the compensation location error. Thus, it is required to correct the location parameter; in FIG. 3, the B point is the center point of the length of image collected by the camera, and the D point is the center point of the length of the curved liquid crystal panel in the plane development diagram;

Furthermore, in the step 2, a formula of implementing correction to the compensation point location in the image Mura compensation data obtained in the step 1 is:

$$z=\arctan(y/x)\pi/180 \quad (1),$$

wherein z is a distance from the position of the compensation point in the plane development diagram of the curved liquid crystal panel to a vertical center line in the plane development diagram, and y is a distance from the position of the compensation point in the image collected by the camera to a vertical center line of the image, and $x=R\times\cos\{\arcsin[b/(2R)]\}$, and R is a radius of curvature as the curved liquid crystal panel is in a curved state, and b is a length of the image collected by the camera.

Specifically, in the top view diagram shown in FIG. 3, the curved liquid crystal panel is an circular arc. The image collected by the camera is the chord of the circular arc. The E point is the actual location of the compensation point, which is the A point corresponding to the position in the image collected by the camera. The radius of the circular arc is set to be R, and the chord length is b, and then BC=b/2, and ∠BOC=θ=arcsin[b/(2R)], OB=x=R*cos θ=R*cos{arcsin[b/(2R)]}, and AB is set to be y, and then ∠AOB=α=arctan(y/x), and thus, the arc length DE==απR/180=arctan(y/x)TrR/180, wherein y is the length of the straight line AB, i.e. a distance from the position of the compensation point in the image collected by the camera to a vertical center line of the image, and x=R×cos{arcsin[b/(2R)]}. Namely, the corresponding location relationship (the B or D location is the center point) of the arc length DE and the straight line AB can be obtained.

Thus, the location of the compensation point of the curved liquid panel in the plane development diagram can be found with the location of the compensation point in the image collected by the camera. Then, the corresponding location relationship is utilized to make the compensation value back to the correct location. Accordingly, the Mura compensation system can implement the correct Mura compensation to the curved liquid crystal panel in the curved state.

step 3, implementing Mura compensation to the curved liquid crystal panel according to the plane Mura compensation data obtained in the step 2.

Specifically, in the step 1, the camera shoots the curved liquid crystal panel three times, and gray scales of images as shooting the curved liquid crystal panel for the three times are different, and there are three copies of the obtained image Mura compensation data.

Specifically, in the step 1, a gray scale of an image shown by the curved liquid crystal panel is selected from a gray scale range including a 0 gray scale and a maximum gray scale, wherein the maximum gray scale is 255.

In conclusion, the present invention provides a compensation method of Mura phenomenon of a curved liquid crystal panel. First, obtaining image Mura compensation data of the curved liquid crystal panel according to a collected image of a camera, and the image Mura compensation data comprises: a Mura compensation value and a compensation point location corresponded with the Mura compensation value, and the compensation point location is a location of a compensation point in the collected image of the camera, and then implementing correction to the compensation point location in the obtained image Mura compensation data to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel, and finally, implementing Mura compensation to the curved liquid crystal panel according to the plane Mura compensation data. Accordingly, the position of the compensation point in the curved liquid crystal panel can be accurately found to correctly implement Mura compensation to the curved liquid crystal panel in the curved state and to promote the product quality of the curved liquid crystal panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A compensation method of Mura phenomenon of a curved liquid crystal panel, comprising steps of:

step 1, providing the curved liquid crystal panel and a camera, and shooting the curved liquid crystal panel of showing an image with the camera, and obtaining image Mura compensation data of the curved liquid crystal panel according to a collected image;

wherein the image Mura compensation data comprises: a Mura compensation value and a compensation point location corresponded with the Mura compensation value, and the compensation point location is a location of a compensation point in the collected image of the camera;

step 2, implementing correction to the compensation point location in the image Mura compensation data obtained in the step 1 to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel;

step 3, implementing Mura compensation to the curved liquid crystal panel according to the plane Mura compensation data obtained in the step 2;

wherein in the step 1, the camera is in a fixed position for shooting the LCD panel;

wherein in the step 1, the camera is located above a center point of the curved liquid panel for shooting, and wherein in the step 2, a formula of implementing correction to the compensation point location in the image Mura compensation data obtained in the step 1 is:

$$z=\arctan(y/x)\pi rR/180,$$

wherein z is a distance from the position of the compensation point in the plane development diagram of the curved liquid crystal panel to a vertical center line in the plane development diagram, and y is a distance from the position of the compensation point in the image collected by the camera to a vertical center line of the image, and x=Rxcos{arcsin[b/(2R)]}, and R is a radius of curvature as the curved liquid crystal panel is in a curved state, and b is a length of the image collected by the camera.

2. The compensation method of Mura phenomenon of the curved liquid crystal panel according to claim 1, wherein in the step 1, the image collected by the camera is a plane image.

3. The compensation method of Mura phenomenon of the curved liquid crystal panel according to claim 1, wherein in the 1, the camera shoots the curved liquid crystal panel three times, and gray scales of images as shooting the curved liquid crystal panel for the three times are different, and there are three copies of the obtained image Mura compensation data.

4. The compensation method of Mura phenomenon of the curved liquid crystal panel according to claim 3, wherein in the step 1, a gray scale of an image shown by the curved liquid crystal panel is selected from a gray scale range including a 0 gray scale and a maximum gray scale.

5. The compensation method of Mura phenomenon of the curved liquid crystal panel according to claim 4, wherein the maximum gray scale is 255.

6. A compensation method of Mura phenomenon of a curved liquid crystal panel, comprising steps of:

step 1, providing the curved liquid crystal panel and a camera, and shooting the curved liquid crystal panel of showing an image with the camera, and obtaining image Mura compensation data of the curved liquid crystal panel according to a collected image;

wherein the image Mura compensation data comprises: a Mura compensation value and a compensation point location corresponded with the Mura compensation value, and the compensation point location is a location of a compensation point in the collected image of the camera;

step 2, implementing correction to the compensation point location in the image Mura compensation data obtained in the step 1 to acquire a compensation point location after correction, and the compensation point location after correction is a position of the compensation point in a plane development diagram of the curved liquid crystal panel, and the compensation point location after correction is employed to replace the compensation point location in the image Mura compensation data to obtain plane Mura compensation data of the curved liquid crystal panel;

step 3, implementing Mura compensation to the curved liquid crystal panel according to the plane Mura compensation data obtained in the step 2;

wherein in the step 1, the camera is in a fixed position for shooting the LCD panel;

wherein in the step 1, the camera shoots the curved liquid crystal panel three times, and gray scales of images as shooting the curved liquid crystal panel for the three times are different, and there are three copies of the obtained image Mura compensation data;

wherein in the step 1, the camera is in above a center point or the curved liquid panel for shooting, and wherein in the step 2, a formula of implementing correction to the compensation point location in the image Mura compensation data obtained in the step 1 is $$z = \arctan(y/x)\pi rR\ 180,$$

wherein z is a distance from the position of the compensation point in the plane development diagram of the curved liquid crystal panel to a vertical center line in the plane development diagram, and y is a distance from the position or the compensation point in the image collected by the camera to a vertical center line of the image, and $x = R\times\cos\{\arcsin[b/(2R)]\}$, and R is a radius of curvature as the curved liquid crystal panel is in a curved state, and b is a length of the image collected by the camera.

7. The compensation method of Mura phenomenon of the curved liquid crystal panel according to claim 6, wherein in the step 1, the image collected by the camera is a plane image.

8. The compensation method of Mura phenomenon of the curved liquid crystal panel according to claim 6, wherein n the step 1, a gray scale of an image shown by the curved liquid crystal panel is selected from a gray scale range including a 0 gray scale and a maximum gray scale.

9. The compensation method of Mura phenomenon of the curved liquid crystal panel according to claim 8, wherein the maximum gray scale is 255.

* * * * *